US005405010A

United States Patent [19]

Goldberger

[11] Patent Number: 5,405,010

[45] **Date of Patent: * Apr. 11, 1995**

[54] BOOKMARK EYEGLASS CASE COMBINATION

[76] Inventor: Irwin Goldberger, 991 Benton St., Woodmere, N.Y. 11598

[ * ] Notice: The portion of the term of this patent subsequent to Jul. 5, 2011 has been disclaimed.

[21] Appl. No.: 255,654

[22] Filed: Jun. 8, 1994

Related U.S. Application Data

[63] Continuation-in-part of Ser. No. 36,713, Mar. 25, 1993, Pat. No. 5,325,959.

[51] Int. Cl.[6] ..... A45C 11/04

[52] U.S. Cl. ..... 206/5; 206/38; 206/472; 224/901; 281/42

[58] Field of Search ..... 206/5, 38, 472, 473; 224/252, 253, 901; 281/42

[56] References Cited

U.S. PATENT DOCUMENTS

| | | | |
|---|---|---|---|
| D. 325,929 | 5/1992 | Larson et al. . | |
| 1,842,599 | 1/1932 | Fraser | 206/5 |
| 2,300,216 | 10/1942 | Grodsky et al. . | |
| 2,557,552 | 6/1951 | Martin | 206/5 |
| 2,777,489 | 1/1957 | Stegeman | 206/5 |
| 3,949,916 | 4/1976 | Yount | 224/253 |
| 4,162,800 | 7/1979 | Gonot, Jr. et al. . | |
| 4,267,923 | 5/1981 | Baratelli et al. | 206/5 |
| 4,500,019 | 2/1985 | Curley, Jr. | 224/901 |
| 4,732,107 | 3/1988 | Jacobsen . | |
| 4,819,846 | 4/1989 | Hannemann | 224/901 |
| 4,986,572 | 1/1991 | Kuykendall | 281/42 |
| 5,020,711 | 6/1991 | Kelley | 224/901 |
| 5,054,816 | 10/1991 | Rosengarten | 281/42 |
| 5,170,917 | 12/1992 | Tourigny | 224/901 |
| 5,213,241 | 5/1993 | Dewar et al. | 206/5 |
| 5,325,959 | 7/1994 | Goldberger | 206/5 |

*Primary Examiner*—David T. Fidei
*Attorney, Agent, or Firm*—Collard & Roe

[57] ABSTRACT

A bookmark strap fits through a book and has one end connected to an eyeglass case. At the other end of the bookmark are VELCRO ® circular patches or rectangular sections so that when the bookmark strap is placed onto the page where a reader has stopped reading, the rest of the extended length of the bookmark strap can be wrapped around to the front of the book and be connected to the back of the eyeglass case to a corresponding VELCRO ® patch. This will lock the bookmark and eyeglass case around the book, with the eyeglass case conveniently positioned on the top cover page of the book.

6 Claims, 3 Drawing Sheets

FIG. 1
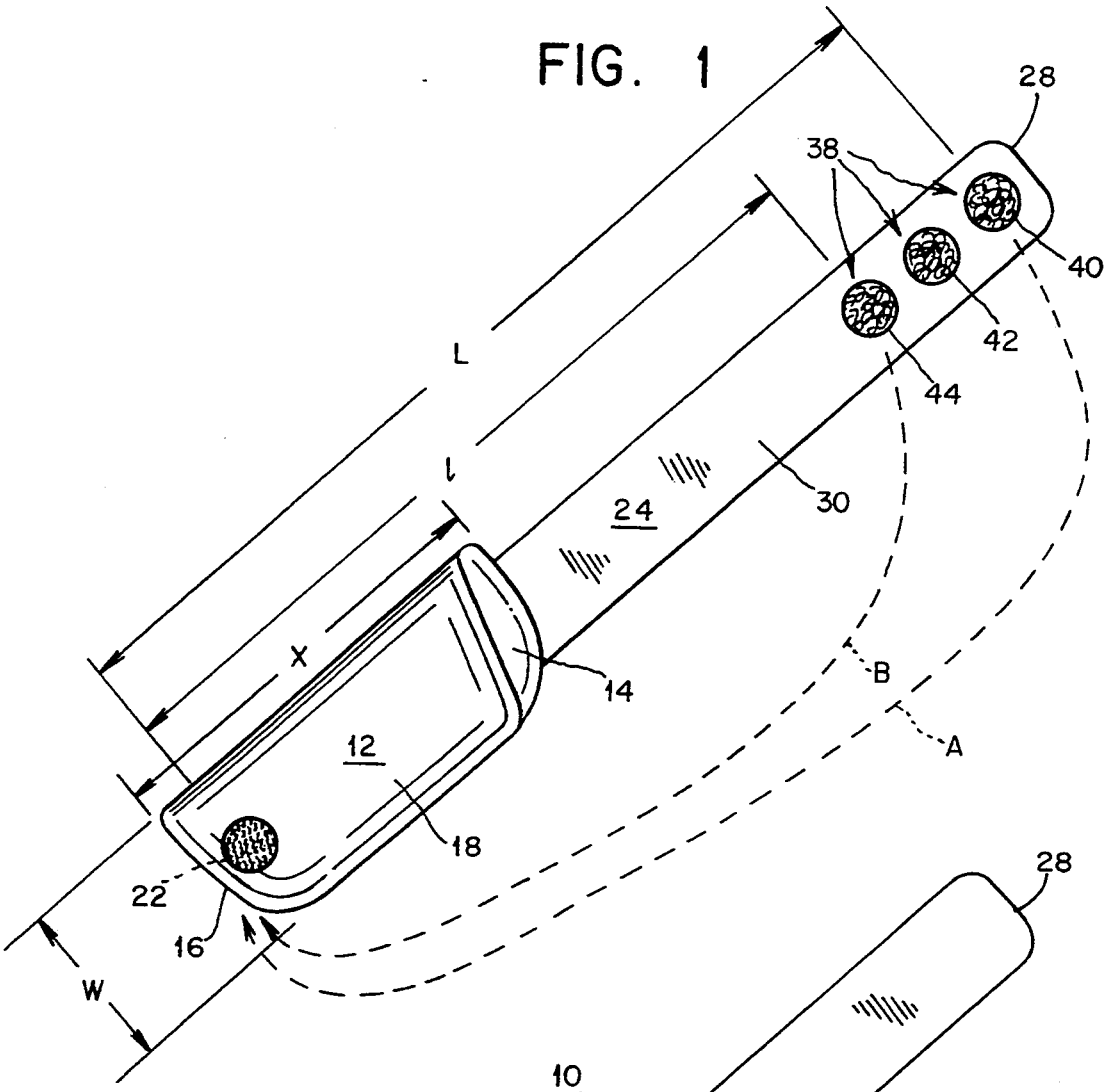
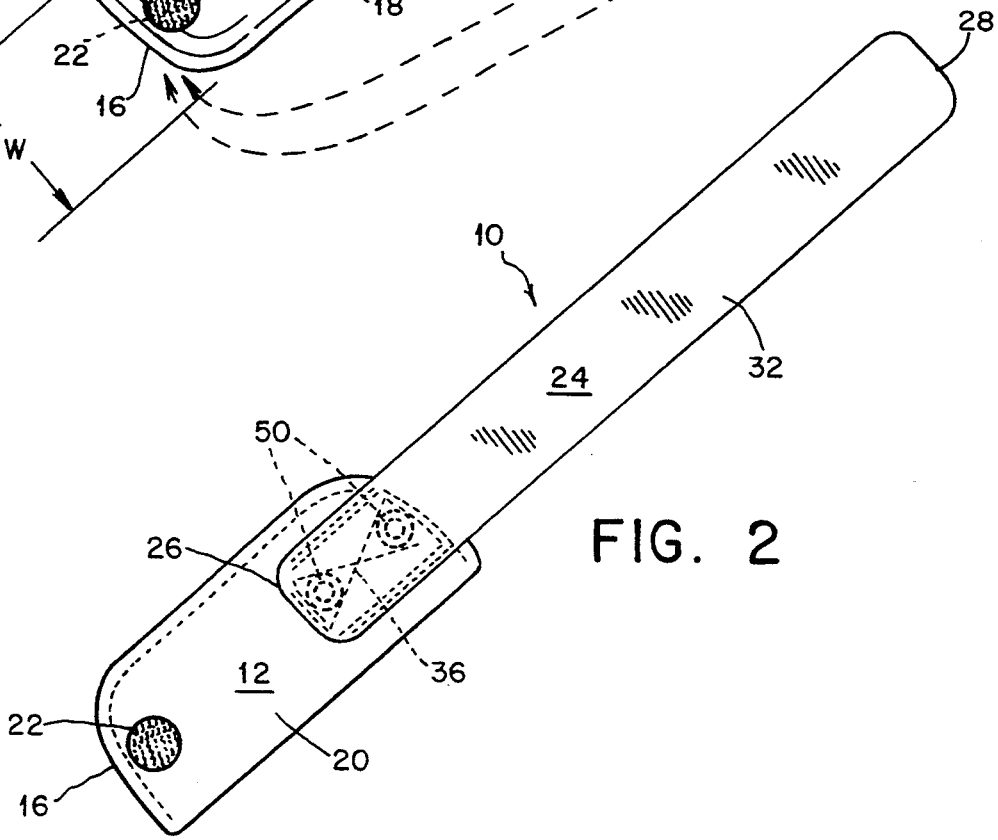
FIG. 2

FIG. 5
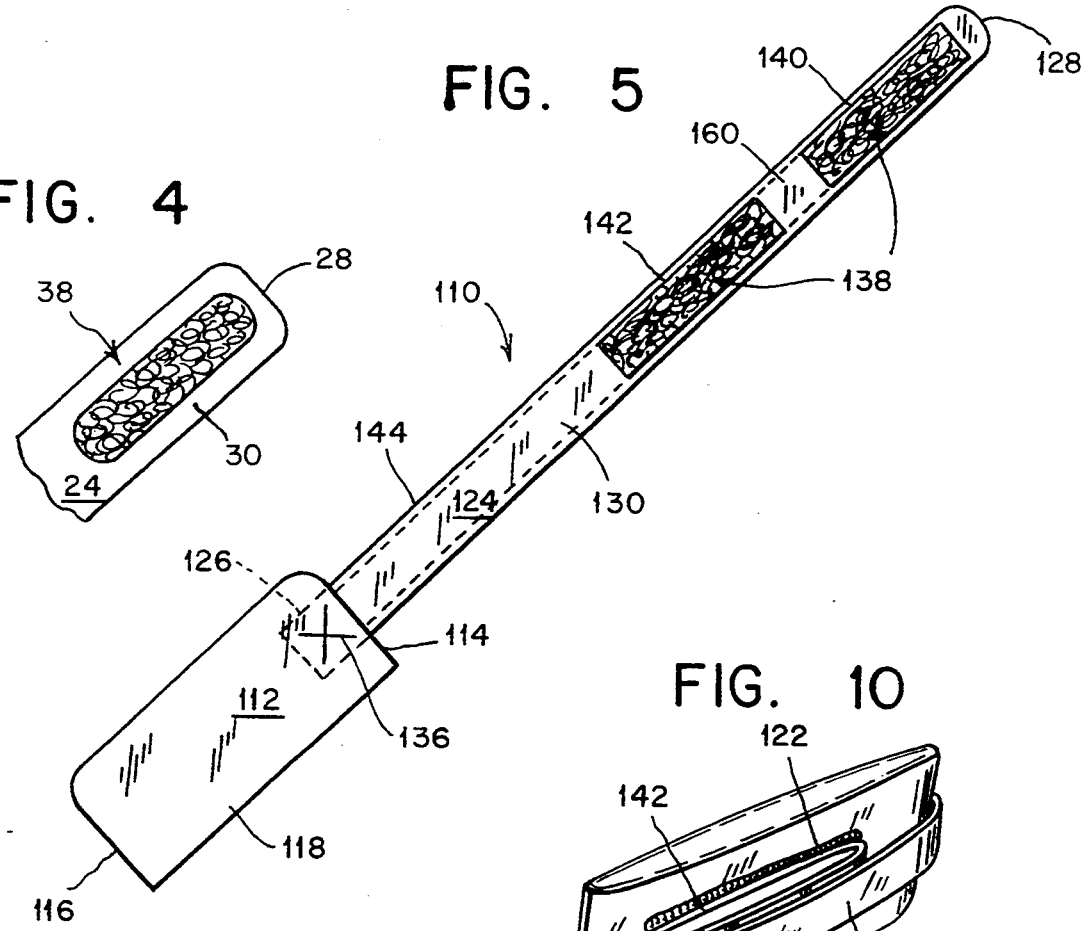
FIG. 4
FIG. 10
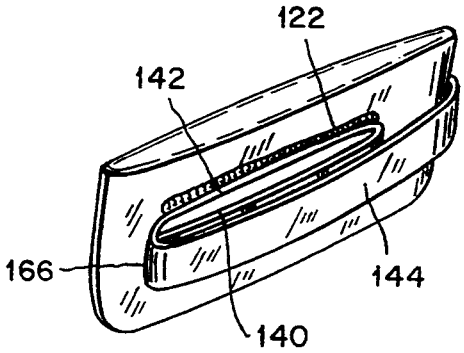
FIG. 9
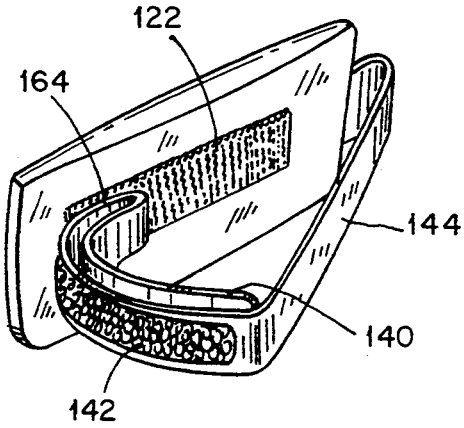

BOOKMARK EYEGLASS CASE COMBINATION

CROSS-REFERENCE TO RELATED APPLICATION

This patent application is a continuation-in-part of U.S. patent application Ser. No. 08/036,713 filed Mar. 25, 1993, now U.S. Pat. No. 5,325,959, issued Jul. 5, 1994.

BACKGROUND OF THE INVENTION

1. Field of the Invention

The present invention relates to a combination bookmark eyeglass case in which a bookmark strap fits around and through a book, with one end of the strap permanently fastened to one end of an eyeglass case and the other end of the strap releasably attached to another end of the eyeglass case.

2. The Prior Art

The Gonot, Jr. U.S. Pat. No. 4,162,800 discloses the combination of an elastic bookmark and a holder for writing instruments which permits the bookmark to be attached to a variety of different books, and which will also releasably hold a writing instrument. The bookmark consists of a loop of elastic material which may be either seamless or it may be joined together with a seam.

This reference, however, fails to show an eyeglass case in combination with the bookmark, whereby it would be possible to adjust the length of the bookmark very substantially. In addition, Gonot does not suggest that the use of a holder could also function as part of the adjustable attachment means.

The Jacobsen U.S. Pat. No. 4,732,107 shows a removable page marker for a book.

The Grodsky U.S. Pat. No. 2,300,216 shows a combination bookmark and pencil holder which merely rests in between the pages of the book and does not actually fold completely around and encase the book.

The Larson Design Pat. No. 325,929 shows a design for a combination bookmark and pencil holder which is similar to Grodsky as discussed above.

SUMMARY OF THE INVENTION

It is an object of the present invention to provide a bookmark in combination with an eyeglass case, wherein the bookmark and the eyeglass case also function as part of an adjustable fastener combination.

The above object is accomplished in accordance with the present invention by providing a bookmark and eyeglass case combination comprising an eyeglass case having an open end and a closed end, with a top side extending between the open end and the closed end, and with a bottom side extending between the open end and the closed end. There is an eyeglass case attachment means on the eyeglass case for releasably attaching the eyeglass case to a bookmark. Also, there is a bookmark having a first end and a second end, with a top surface extending between the first end and the second end, and with a bottom surface extending between the first end and the second end. There is a bookmark attachment means on the bookmark for releasably attaching the bookmark to the eyeglass case attachment means, and there is a means for releasably or permanently fastening the first end of the bookmark to an end of the eyeglass case.

The present invention is directed to a bookmark strap that fits around and through a book and has one end that is releasably or permanently connected to an eyeglass case. At the end of the eyeglass case is a releasable attachment means such as a VELCRO® patch (i.e., hook-and-loop type fastener) or a snap. At the other end of the bookmark strap are various VELCRO® patches or snaps that are aligned in tandem with each other in such a way that when the VELCRO® hook, or the snap on the eyeglass case is brought into contact with the wrapped around strap of the bookmark, it is possible to adjust the overall length of the bookmark based upon the particular VELCRO® patch or snap to which the VELCRO® is meshed or the snap is connected.

Hence, it is possible to adjust the overall circular length of the bookmark to accommodate books of various dimensions, lengths and thicknesses, depending on the number of pages necessary to encompass. In other words, when the bookmark is placed around the outside of the book after the reader has stopped reading, the length of the bookmark is adjustable so that when it is wrapped around the front of the book and comes into contact with the eyeglass case to mesh with the corresponding VELCRO® hook or snap, the eyeglass case will always be snugly resting and held conveniently in place on the outside top cover of the book.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views:

FIG. 1 is a top view of a first embodiment of the combination of the present invention showing the top side of the eyeglass case and the top surface of the bookmark having bookmark attachment means thereon;

FIG. 2 is a bottom view of the first embodiment of the combination of FIG. 1 showing the bottom side of the eyeglass case having attachment means thereon and the bottom surface of the bookmark;

FIG. 4 shows a single bookmark attachment means;

FIG. 5 is a top view of a second embodiment of the combination of the present invention showing the top side of the eyeglass case and the top surface of the bookmark having bookmark attachment means thereon;

FIG. 9 is a perspective view of the combination of FIG. 5 showing a portion of the second rectangular section attachment means of the bookmark coupled to the eyeglass case attachment means; and FIG. 10 is a perspective view of the combination of FIG. 5 showing the entire second rectangular section attachment means of the bookmark coupled to the eyeglass case attachment means.

DETAILED DESCRIPTION OF PREFERRED EMBODIMENTS

Figure 6:
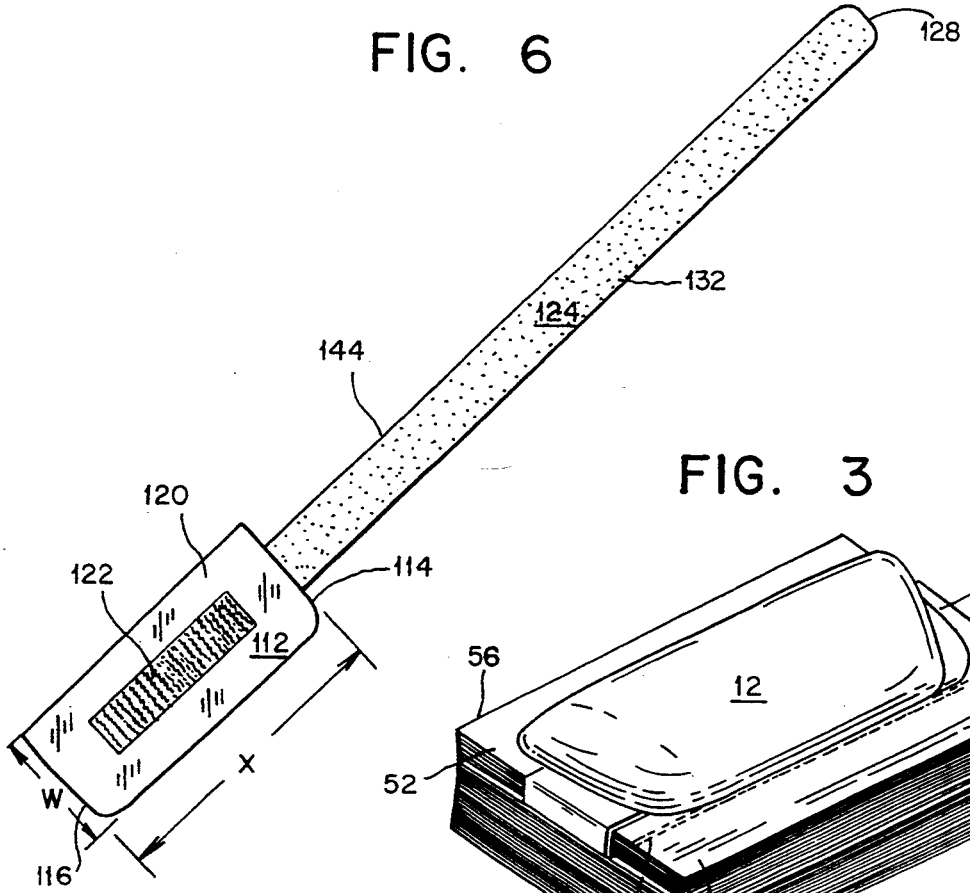
FIG. 6 is a bottom view of the second embodiment of the combination of FIG. 5 showing the bottom side of the eyeglass case having attachment means thereon and the bottom surface of the bookmark.

Turning now in detail to the drawings, FIGS. 1 and 2 show a first embodiment of a bookmark and eyeglass case combination 10 including an eyeglass case 12 having an open end 14 and a closed end 16, with a length x extending from open end 14 to closed end 16 and a width w whereby length x is greater than width w, with a top side 18 (FIG. 1) extending between the open end 14 and the closed end 16, and with a bottom side 20 (FIG. 2) extending between the open end 14 and the closed end 16. An eyeglass case attachment means 22 is located on the eyeglass case 12 at the closed end 16 for releasably attaching the eyeglass case to a bookmark 24. The eyeglass case is usually made by known construction and can be composed of a thermoplastic material such as polyvinyl chloride, or of a composite laminate of several different plastic materials bonded together. A pair of eyeglasses (not shown) may be inserted into, or withdrawn from, the open end 14 of the case 12.

The bookmark 24 has a first end 26 and a second end 28, with a top surface 30 extending between the first end 26 and the second end 28, and with a bottom surface 32 extending between the first end 26 and the second end 28. The bookmark is usually made by known construction and is usually composed of a thermoplastic material such as polyvinyl chloride, or of a composite laminate of several different plastic materials bonded together.

A bookmark attachment means 38 is located on the second end 28 of the bookmark for releasably attaching the bookmark 24 to the eyeglass case attachment means 22. Fastener means 36 may releasably or permanently fasten the first end 26 of the bookmark 24 to the open end or the closed end of the eyeglass case 12. Preferably, the bookmark first end 26 is fastened to the bottom side 20 at the open end 14 of the eyeglass case 12.

In one embodiment, the eyeglass case attachment means 22 is located on the bottom side 20 of the eyeglass case 12 adjacent to the closed end 16 of the eyeglass case. The bookmark attachment means 38 is located on the top surface 30 of the bookmark 24 adjacent to the second end 28 of the bookmark.

In a further embodiment, the eyeglass case attachment means and the bookmark attachment means could be transposed in location. Thus, the eyeglass case attachment means 22 could be located on the bookmark at end 28, where the bookmark attachment means 38 is now positioned, as shown in FIG. 1. Then the bookmark attachment means 40, 42 and 44 could be transposed and relocated onto the eyeglass case at end 16, where the eyeglass case attachment means 22 is now positioned, as shown in FIG. 2.

The fastening means 36 can releasably fasten or can permanently fasten the first end 26 of the bookmark to the open end 14 of the eyeglass case 12. As shown in FIG. 2, means 36 preferably is made of any known type of permanent fastener, such as stitching with thread, staples, brackets or clips. In another embodiment, this fastener at end 26 can be snaps 50 for releasably fastening the first end 26 of the bookmark to open end 14 of the eyeglass case.

In a further embodiment, the eyeglass case attachment means 22 and the bookmark attachment means 38 are the two component parts of a VELCRO® hook-and-loop type of fastener, which are preferably shaped as circular patches. As shown in FIG. 1, the bookmark attachment means 38 includes a series of linearly aligned attachment elements 40, 42 and 44 including a first attachment element 40 adjacent to the second end 28 of the bookmark 24 and a last attachment element 44 farthest removed from the second end 28 of the bookmark and closest to the first end 26 of the bookmark. Intermediate attachment element 42 is located between the first and the last attachment elements. Preferably, each element 40, 42 or 44 is a VELCRO® circular patch.

In another embodiment, means 22 and means 38 can be the two component parts of a matingly engageable pair of snaps (not shown).

In a further embodiment, the bookmark attachment means 38*a*, shown in FIG. 4, is a simple VELCRO® patch having a width equal to the diameter of circular patch 40 and having a length equal to the total distance between patch 40 and patch 44 measured as the distance between length L minus length l, plus the diameter of one of the patches 40, 42 or 44.

Figure 3:
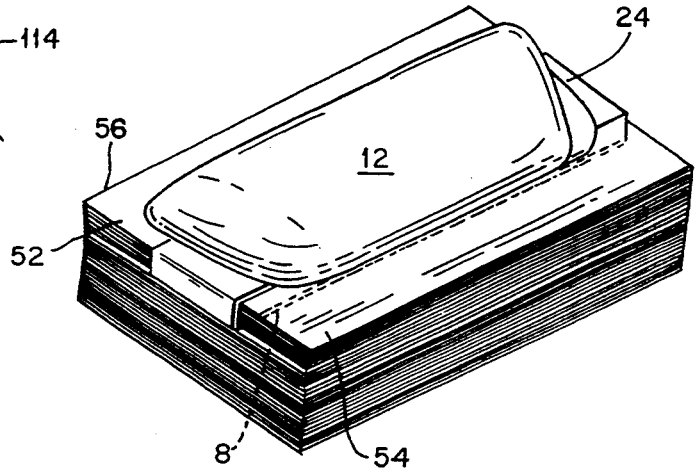
FIG. 3 shows a perspective view of the eyeglass case held in place on the outside top cover of a book by the bookmark strap.

According to the present invention, when the combination bookmark eyeglass case 10 is placed around the outside of the book 56, as shown in FIG. 3, bookmark 24 encircles a plurality of pages 52 in addition to the outside top cover 54 of the book, such that eyeglass case 12 snugly rests on the encircled cover 54 and bookmark 24 encloses the plurality of pages of the book parallel to the bottom side 20 of the eyeglass case.

According to the present invention, the combination 10 bookmark and eyeglass case has a maximum circumferential length L and has a minimum circumferential length l. Thus, whenever the first attachment element 40 of the bookmark attachment means 38 is releasably attached to the eyeglass case attachment means 22, then this combination 10 has a maximum circumferential length L. This maximum circumferential length will be produced by folding the bookmark second end 28 along the circular path (A) illustrated in FIG. 1.

Hence, whenever the last attachment element 44 of the bookmark attachment means 38 is releasably attached to the eyeglass case attachment mean 22, then this combination 10 has a minimum circumferential length l. This minimum circumferential length l will be produced by folding the bookmark second end 28 along the circular path (B) illustrated in FIG. 1. Thus, by adjusting the circumferential length, it is possible to adjust the combination bookmark and eyeglass case to encompass different sized books, or to surround different numbers of pages being marked within the same book.

In a further embodiment, the combination 10 also has an intermediate circumferential length, based upon attaching the intermediate attachment element 42 to the eyeglass case attachment means 22.

FIGS. 5 to 10 illustrate a second embodiment.

Turning now in detail to the drawings, FIGS. 5 and 6 show a bookmark and eyeglass case combination 110 including an eyeglass case 112 having an open end 114 and a closed end 116, with a length X extending from open end 114 to closed end 116 and a width w whereby length x is greater than width w, with a top side 118 (FIG. 5) extending between the open end 114 and the closed end 116, and with a bottom side 120 (FIG. 6) extending between the open end 114 and the closed end 116. An eyeglass case attachment means 122 is located on the eyeglass case 112 on the bottom side 120 parallel to the length x for releasably attaching the eyeglass case to a bookmark 124. The eyeglass case is usually made by known construction and can be composed of a thermoplastic material such as polyvinyl chloride, or of a composite laminate of several different plastic materials bonded together. A pair of eyeglasses (not shown) may be inserted into, or withdrawn from, the open end 114 of the case 112.

The bookmark 124 has a first end 126 and a second end 128, with a top surface 130 extending between the first end 126 and the second end 128, and with a bottom surface 132 extending between the first end 126 and the second end 128. The bookmark is usually made by known construction and is usually composed of a thermoplastic material such as polyvinyl chloride, or of a composite laminate of several different plastic materials bonded together.

A bookmark attachment means 138 is located on the second end 128 of the bookmark for releasably attaching the bookmark 124 to the eyeglass case attachment means 122. Fastener means 136 may releasably or permanently fasten the first end 126 of the bookmark 124 to the open end or the closed end of the eyeglass case 112. Preferably, the bookmark first end 126 is fastened to the top side 128 at the open end 114 of the eyeglass case 112.

The eyeglass case attachment means 122 is located on the bottom side 120 of the eyeglass case 112 and is rectangular in shape and runs parallel to the length x of the eyeglass case. Means 122 has a length about 4 to 6 times the width. The bookmark attachment means 138 is located on the top surface 130 of the bookmark 124 adjacent to the second end 128 of the bookmark.

Bookmark attachment means 138 includes a first rectangular section attachment element 140 adjacent to second end 128, and includes a second rectangular section attachment element 142 a spaced distance from element 140 separated by distance 160. Each element 140 and 142 is a rectangle having a length and width approximately equal to the length and the width, respectively, of the eyeglass case attachment means 122. Rectangular element 140 is preferably congruent to rectangular element 142. Element 140, element 142 and means 122 are all part of a VELCRO ® hook-and-loop type of fastener system.

That portion 144 of the bookmark 124 which is located between the second rectangular element 142 and the open end 114 of the eyeglass case 112 is devoid of any bookmark attachment means elements.

Figure 7:
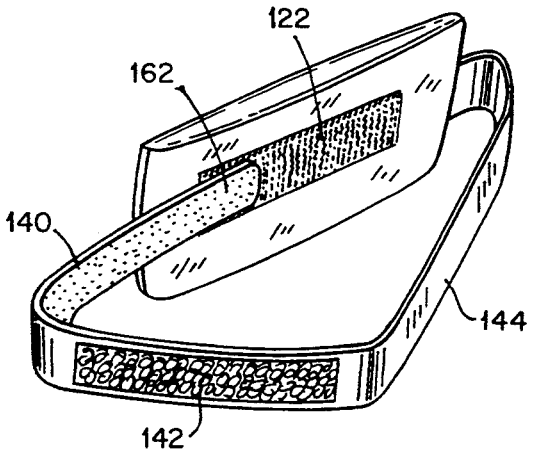
FIG. 7 is a perspective view of the combination of FIG. 5 showing a portion of the first rectangular section attachment means of the bookmark coupled to the eyeglass case attachment means.
Figure 8:
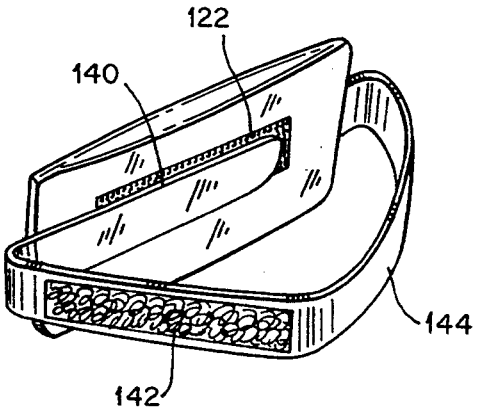
FIG. 8 is a perspective view of the combination of FIG. 5 showing the entire first rectangular section attachment means of the bookmark coupled to the eyeglass case attachment means.

While FIGS. 5 and 6 illustrate the bookmark eyeglass case combination when not in use surrounding a portion of a book, FIGS. 7 to 9 illustrate this combination when in use and available to surround a portion of a book. FIG. 10 illustrates this combination, wherein the bookmark 124 is wrapped around itself into a very compact spiral. In this compact spiral condition the bookmark 124 is not available to surround a portion of a book.

FIG. 7 is a perspective view of the combination of FIG. 5 showing a portion 126 of the first rectangular section attachment means 140 of the bookmark coupled to the eyeglass case attachment means 122.

FIG. 8 is a perspective view of the combination of FIG. 5 showing the entire first rectangular section attachment means 140 of the bookmark coupled to the eyeglass case attachment means 122.

FIG. 9 is a perspective view of the combination of FIG. 5 showing a portion 164 of the second rectangular section attachment means 142 of the bookmark coupled to the eyeglass case attachment means 122.

FIG. 10 is a perspective view of the combination of FIG. 5 showing the entire second rectangular section attachment means 142 of the bookmark coupled to the eyeglass case attachment means 122. This will produce compact spiral 166 in which none of the bookmark 124 is available to surround a portion of a book. This is because the first rectangular section 140 is placed between section 144 and the second rectangular section 142 which is coupled to the eyeglass case attachment means 122.

As can be observed from FIGS. 7, 8 and 9, there is a progressively decreasing amount of the bookmark 124 available for use from FIG. 7 to FIG. 8 to FIG. 9. This is because in FIG. 7, all of section 144, all of section 142 and most of section 140 are jointly available for use in surrounding a portion of a book, and thus comprise the maximum available amount of the bookmark 124. In FIG. 8, all of section 144 and all of section 142 are jointly available for use in surrounding a portion of a book. In FIG. 9, all of section 144 and part of section 142 are jointly available for use in surrounding a portion of a book, and thus comprise the minimum available amount of the bookmark 124.

These features enable the bookmark eyeglass case together to have the advantages that they can function as an adjustable fastener combination, in addition to being a bookmark and a housing for a book reader's pair of glasses.

While several embodiments of the present invention have been shown and described, it is to be understood that many changes and modifications may be made thereunto without departing from the spirit and scope of the invention as defined in the appended claims.

What is claimed is:

1. A bookmark and eyeglass case combination in combination with a book, said book having an outside top cover, comprising:

an eyeglass case having an open end and a closed end, with a length and a width, said length being a distance between said open end and said closed end with said length being greater than said width, with a top side extending between said open end and said closed end, and with a bottom side extending between said open end and said closed end;

an eyeglass case attachment means on said eyeglass case for releasably attaching said eyeglass case to a bookmark, said eyeglass case attachment means being a rectangle running lengthwise along the length of said eyeglass case;

a bookmark having a first end and a second end, with a top surface extending between said first end and said second end, and with a bottom surface extending between said first end and said second end;

a bookmark attachment means on said bookmark for releasably attaching said bookmark to said eyeglass case attachment means, said bookmark attachment means comprising a first rectangular section attachment element and a second rectangular section attachment element adjacent to said first element; and means for fastening said first end of said bookmark to an end of said eyeglass case;

wherein said eyeglass case is held in place on the outside top cover of the book.

2. The combination of claim 1, wherein said eyeglass case attachment means, said first rectangular section attachment element, and said second rectangular section attachment element are approximately equal in size to each other.

3. The combination of claim 1, wherein said eyeglass case attachment means, said first rectangular section attachment element, and said second rectangular section attachment element are congruent with each other.

4. A bookmark and eyeglass case in combination with a book, said book having a plurality of pages disposed between the covers of said book, said combination comprising:

an eyeglass case having an open end and a closed end, with a top side extending between said open end and said closed end, and with a bottom side extending between said open end and said closed end;

an eyeglass case attachment means on said eyeglass case for releasably attaching said eyeglass case to a bookmark, said eyeglass case attachment means being a rectangle running lengthwise along the length of said eyeglass case;

a bookmark having a first end and a second end, with a top and bottom surface both extending between said first end and said second end;

a bookmark attachment means on said bookmark for releasably attaching said bookmark to said eyeglass case attachment means after said bookmark encircles a plurality of pages and one of the book covers, said bookmark attachment means comprising a first rectangular section attachment element and a second rectangular section attachment element adjacent to said first element; and means fastening said first end of said bookmark to an end of said eyeglass case, such that said eyeglass case rests on said one of said covers of said book and said bookmark lies within said plurality of pages parallel to the bottom side of said eyeglass case.

5. The combination according to claim 4, wherein said eyeglass case attachment means is located on the bottom side of said eyeglass case adjacent to said closed end of said eyeglass case.

6. The combination according to claim 4, wherein said bookmark attachment means is located on the top surface of said bookmark adjacent to said second end of said bookmark.

* * * * *